United States Patent [19]

Lombard

[11] 4,173,334

[45] Nov. 6, 1979

[54] UNMANNED CHAIN HOOK-UP FOR LIFTING LOOSE BUNDLES

[76] Inventor: Daniel L. Lombard, P.O. Box 177, Youngstown, Ohio 44501

[21] Appl. No.: 660,263

[22] Filed: Feb. 23, 1976

[51] Int. Cl.[2] ..... B66C 1/12

[52] U.S. Cl. ..... 294/67 E

[58] Field of Search ..... 294/67 R, 67 BA, 67 BB, 294/67 C, 67 D, 67 DA, 67 DB, 67 DC, 67 E, 67 B, 67 AB, 67 AA; 214/750, 730, 731, 16.4 A; 74/245 R, 250 R; 59/78, 78.1

[56] References Cited

U.S. PATENT DOCUMENTS

| | | | |
|---|---|---|---|
| 3,239,088 | 3/1966 | Sano | 214/730 |
| 3,930,587 | 1/1976 | Bliss | 214/750 |

FOREIGN PATENT DOCUMENTS

| | | | |
|---|---|---|---|
| 1072557 | 12/1959 | Fed. Rep. of Germany | 214/730 |
| 301369 | 6/1968 | Sweden | 294/67 BB |
| 1257488 | 12/1971 | United Kingdom | 214/730 |
| 298519 | 6/1971 | U.S.S.R. | 294/67 E |

*Primary Examiner*—James B. Marbert

*Attorney, Agent, or Firm*—William J. Ruano

[57] ABSTRACT

An unmanned chain hook-up or hoist for lifting loose bundles of pipe or other materials. A hoist is hooked so as to lift a framework along the channels of which a novel link chain is driven so as to move underneath the load to be lifted and locked to the framework. The novel chain includes, in each link, a stop to prevent the chain from turning in one direction while not interfering with the turning movement in an opposite direction, the latter permitting the chain to be retracted into the guiding channels of the framework. The chain or a modification is also applicable to a lift truck.

2 Claims, 12 Drawing Figures

UNMANNED CHAIN HOOK-UP FOR LIFTING LOOSE BUNDLES

This invention relates to an unmanned chain hook-up for making heavy lifts from overhead cranes and the like, such as in a metal plant, to lift pipe, slabs, plate, coils, etc. or other heavy material.

An outstanding disadvantage of presently used lifting apparatus, such as overhead cranes, is that they must be manned by requiring the use of one or possibly two hook-up men on the floor,—also they require the use of substantial working space around the load to be lifted.

An object of the present invention is to provide a novel chain hook-up and lifting frame assembly which will overcome the abovenamend disadvantages of commonly used devices.

A more specific object of my invention is to provide a framework for straddling a bundle of loose pipes or other heavy materials to be lifted, which framework is lifted by a hook from any suitable lifting apparatus without the necessity of hook-up men for tying the bundle before lifting. My invention embodies a novel construction of chain having links which can individually turn in one direction only, which links are driven underneath the load to be lifted and locked to the framework before the lifting movement.

Another object of the invention is to apply my novel chain to a lift truck.

Other objects and advantages will become more apparent from a study of the following description taken with the accompanying drawings wherein.

In metal making or fabricating plants employing overhead cranes or the like for lifting pipe, slabs, plates, coils, and other heavy loads, it is customary to use one or two hook-up men on the floor for passing loose cable under the bundle of pipes to be lifted and connecting it to a bar on the opposite side prior to the crane operator's lifting of the pipes.

In accordance with the present invention, no such hook-up men or "hookers" are needed since the present invention effects such hook-up operations automatically, safely, and economically.

Figure 1:
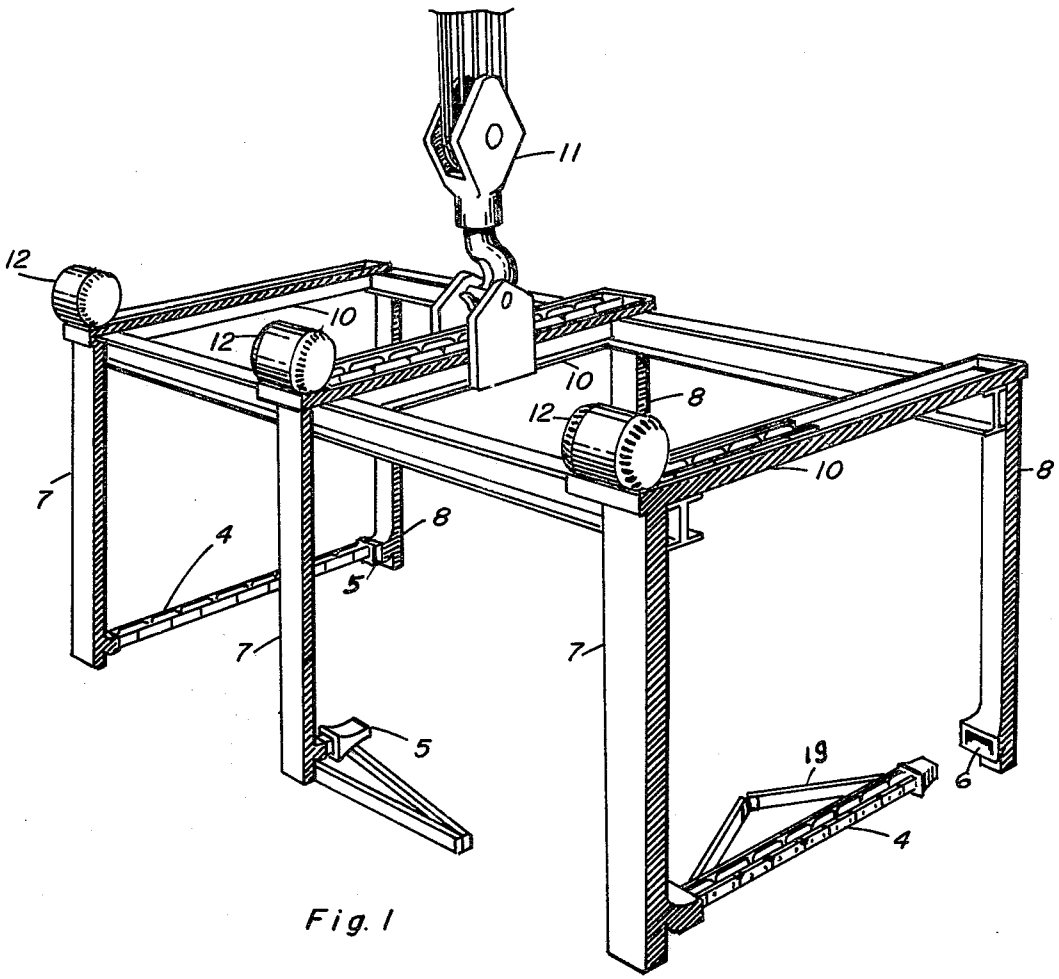
FIG. 1 is a top, perspective view of an unmanned lifting framework assembly embodying a chain constructed according to the principles of the present invention.
Figure 2:
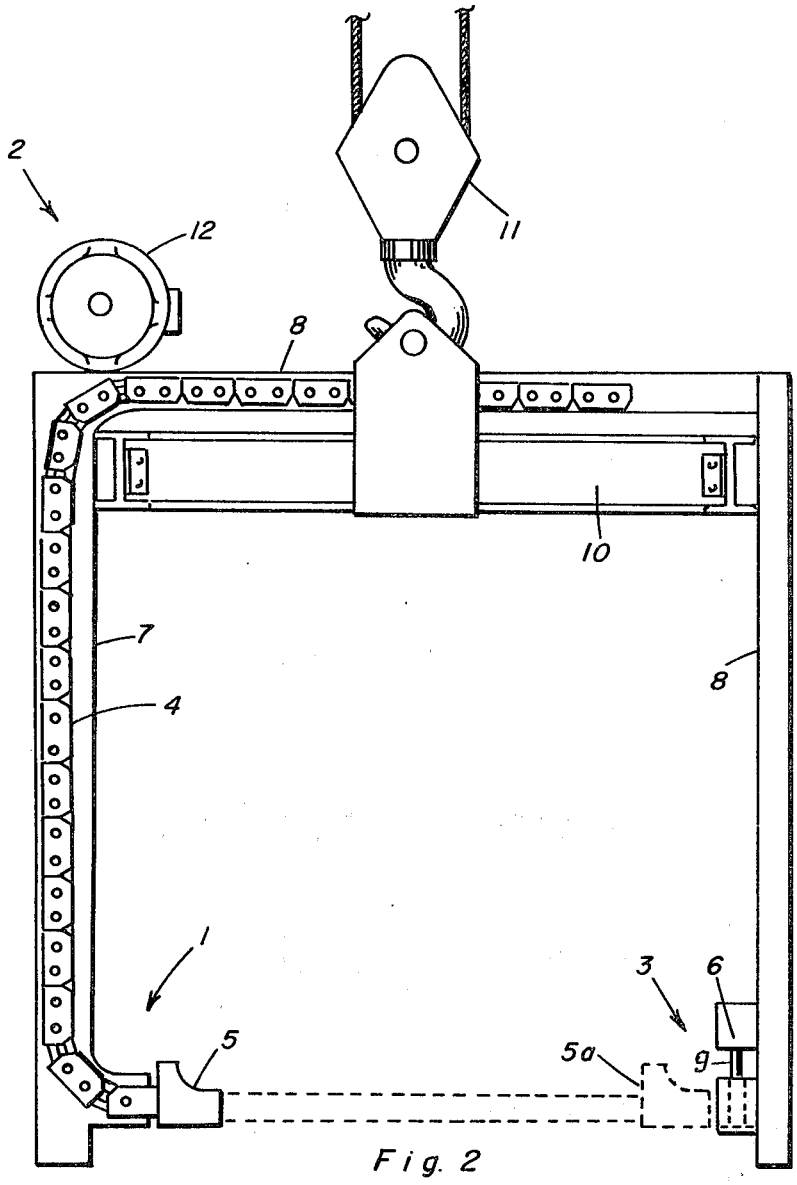
FIG. 2 is an end view of the construction shown in FIG. 1.
Figure 3:
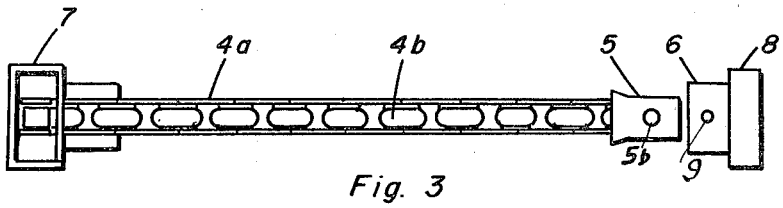
FIG. 3 is a top view of only the lower part of the extended chain when driven underneath the load to be lifted (not shown)
Figure 4:
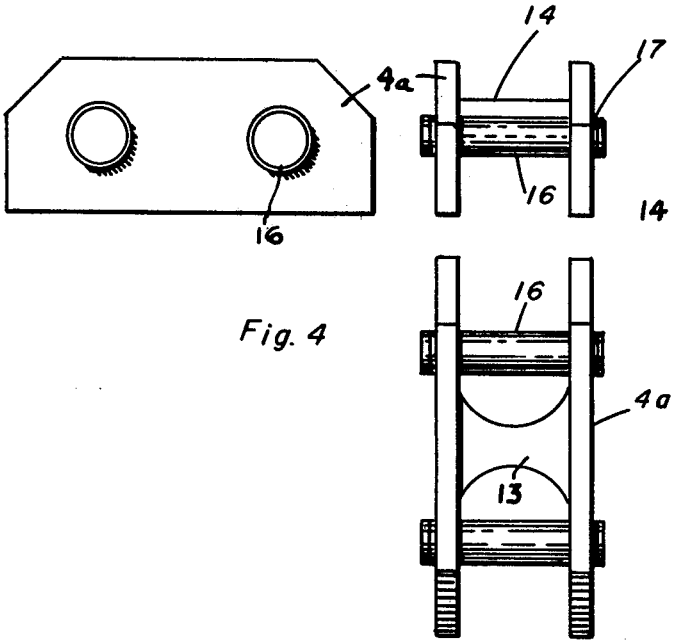
FIG. 4 shows side, end and top views of a guide for coupling two chain links.
Figure 5:
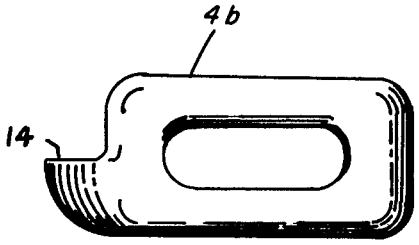
FIG. 5 is a side view of one of the chain links embodying the principles of the present invention.

Referring more particularly to FIGS. 1, 2 and 3, of the drawings, numeral 4 denotes a link chain having a special construction according to the principles of the present invention for enabling the chain to remain horizontally stiff so that when its leading element 5, a male block, projects into a female receptable 6 and is locked thereto, it is in readiness to lift a load thereabove (not shown).

The frame construction comprises either four or six vertical legs 7, 8 (six being shown) which are in the form of guide channels for guiding, by legs 7, vertical retracting movement of the chain 4 when withdrawn from underneath the load to be lifted. As shown more clearly in FIGS. 2 and 3, when the male block 5 is moved underneath the load to be lifted to position 5*a* and in readiness to enter receptacle 6, a proximity switch (not shown) initiates energization of a magnetically operable actuator for driving an armature or pin 9 through hole 5*b* so as to lock the block 5 to leg 8. When this is done, by a suitable electrical signal to the crane operator, he will be assured that the chain is securely fastened to legs 8.

FIG. 1 shows, for purposes of better illustration of the operation of the chains, different positions of the chains, although it should be understood that they generally will be at substantially the same position. For instance, the middle leg 7 is shown with the chain 4 in a completely retracted position such as better shown in FIG. 2. The leg illustrated to the right shows chain 4 in a partially driven position just before contacting leg 8, whereas the chain in the left-most leg 8 is shown in the completely driven and fastened position.

A spreader bar 10, which may be of I-beam construction, is suspended from a crane hook 11, such as from an overhead crane or other types of cranes, and has a chain guide on the top thereof for receiving the retracted chain 4. The chain links are driven by any suitable means in selective directions, such as, for example, by separate reversible motors 12 which are coupled, by spur gears (not shown), to the various chains so that the chains will be selectively driven in either direction by the reversible motor 12.

Instead of driving the various chains by separate motors as shown, a single reversible motor, such as a central motor, may have an elongated drive shaft extending from each side on which is mounted three separate spur gears for driving the three chain simultaneously. In some instances, the top longitudinal frames may comprise telescopic members for adjusting the longitudinal length to suit the length of the load to be lifted.

The essential feature of the present invention resides in the specific construction of the link chain itself, which is best illustrated in FIGS. 4 to 7 inclusive. An ordinary link chain is provided with modifications, for example, the individual links 4*b* (FIG. 5) are provided with projections 14 preferably of arcuate shape which will be stopped from clockwise movement by a lock bar 13 (FIGS. 4 and 6) which extends between chain guides 4*a* and is rigidly mounted on such guides. A plurality of pairs of such guides are aligned longitudinally of the chain and are provided with forty-five degree top corners so as to limit the retractive movement into leg 7 to 90°.

Figure 6:
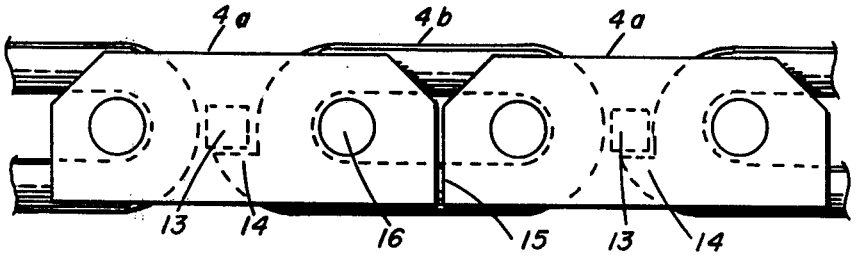
FIG. 6 is a side view showing a fragmentary part of the assembly of guides and chain links shown in FIGS. 4 and 5.
Figure 7:
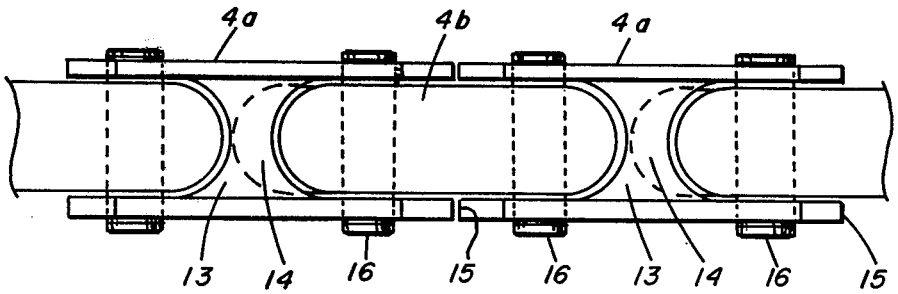
FIG. 7 is a top view of the assembly shown in FIG. 6.

In operation, when the chain, shown in FIGS. 2, 3 and 6, is driven in such direction as to retract it into the vertical leg 7, as shown in FIG. 2, there is nothing to prevent the portion of the chain illustrated at the left of FIG. 6 to bend upwardly at an angle of 90° since the leftmost lock bar 13 is merely lifted away from the dog 14. However, any tendency for the remainder of the chain to bend in the opposite direction is resisted by lock bars 13 which arrest any tendency of clockwise movement of the links by the abutment of each dog 14 against the corresponding lock bar 13 as a stop element. Thus, the chain of FIG. 3, for example, will be stiff in a horizontal direction, therefore will be able to project male block 5 precisely into the receptacle 6. This precision is aided by chain guides 4a which restrain the links from bending laterally, and may be aided still further by the provision of support angles 19, such as shown in FIG. 1 comprising a laterally pivoted pair of links. In some cases pairs of such bars might even suffice without the chain or perhaps with only a cable, however, they would not be as effective as the chain links of the present invention. Such support angles 19 are not indispensable for the present invention because guides 4a alone prevent any tendency for lateral movement of the chain links.

Figure 9:
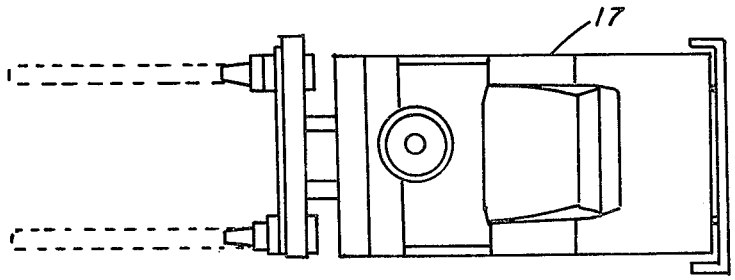
FIGS. 8 and 9 are enlarged side and top views, respectively, of a lift truck modification.
Figure 8:
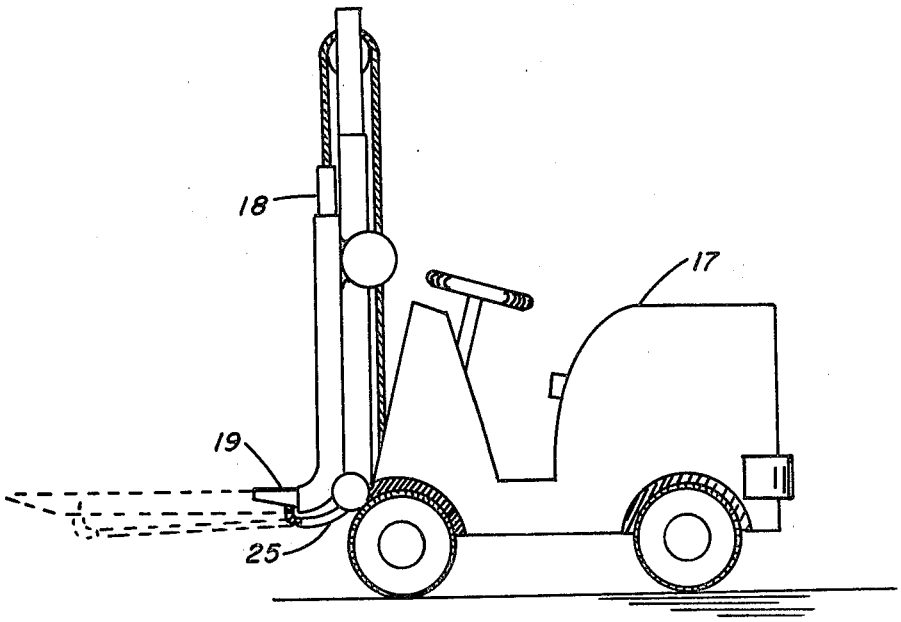

FIGS. 8 and 9 show a lift truck 17 equipped with a chain 18 lifted by a pulley and embodying the present invention, as hereinbefore described. The lead element 19 of the chain can be projected outwardly, as shown in dotted lines, to any desired distance underneath the load to be lifted (not shown). The chain is guided by the guide or retracting element 25, shown in greater detail in FIG. 12.

Figure 10:
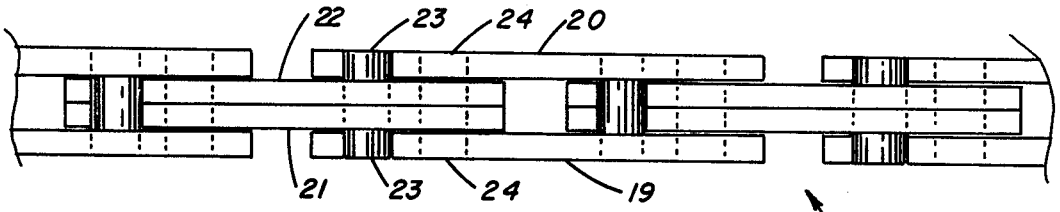
FIGS. 10 and 11 are top and elevation views of a modified chain.
Figure 11:
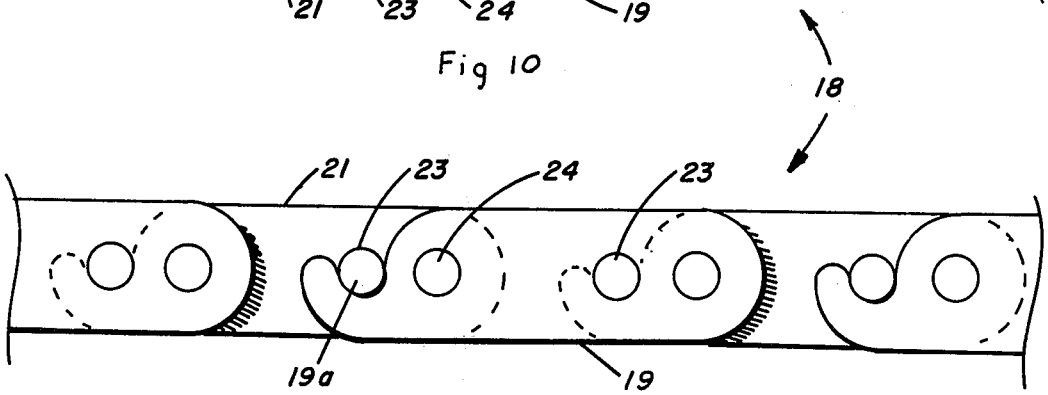
Figure 12:
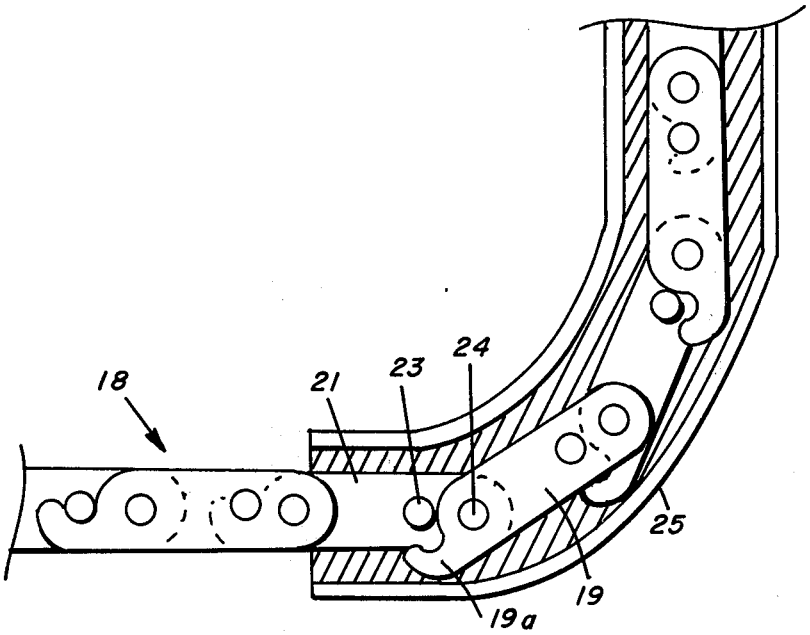
FIG. 12 shows the chain of FIGS. 10, 11 in the lift truck guide 25.

FIGS. 10, 11 and 12 show a modification of the chain which is especially useful for the lift truck 17. Referring to these figures, numeral 18 generally denotes the chain for use in the lift truck and made up of a plurality of pivotally interconnected links, such as links 21, 22, which are shown side by side in FIG. 10. It should be noted however, that a single link, such as 21 may be used alone instead.

Link 19 is provided with a hook portion 19a and a companion link 20 is provided with a correspondingly shaped hook portion. Links 19 and 20 are rigidly secured together by pins, such as 24, which may be welded or otherwise integrally secured. Pins 24 serve as pivots for the adjoining links, such as 21, as shown more clearly in FIG. 12. Pins 23 become seated in hook portions 19a as the adjoining links are moved to the horizontal position, as evident from the chain 18 in FIG. 12.

In operation, as the chain 18 moves downwardly through the guide 25, the links will emerge from the bottom of the guide in a straight line extending horizontally to serve as a support for any weight to be lifted. Because of the seating engagement of pins, such as 23, in the hook portions 19a, the chain link 19 cannot be pivoted downwardly in a counterclockwise direction, therefore the chain will act as a unitary rigid horizontal support. However, when the chain is driven in the opposite direction and retracted upwardly into guide 25, the links will bend counter-clockwise as shown in FIG. 12, so that eventually, practically the entire chain 18 will be retracted inside the guide 25, at which time the lead element 19 will move to the position shown in FIG. 8 so as to make the left truck more maneuverable.

If desired, two links such as 20 side by side may be used,-also two links such as 10 side by side may be used, much the same way as links 20, 21 and 22.

It will be apparent to those skilled in the art that other constructions of chain links 18 may be used for allowing the link to bend only in one direction.

Thus it will be seen that I have provided a highly efficient hook-up chain for eliminating the necessity of laborers or hook-up men, on the floor, for tying a cable or chain around a bundle of pipes or the like before lifting by an overhead crane or any other type of crane; Also which enable the use of less floor space around the load; furthermore, I have provided a novel hook-up chain having links that can turn in only one direction and which are prevented from tilting laterally by chain guides so as to provide a horizontally stiff and straight chain which can be driven by a motor precisely to a target receptacle in which the end of the chain may be securely locked before lifting of the load, thus providing an unmanned, fully automatic chain hook-up for safely lifting very heavy loads. Also, I have applied the chain to a lift truck to enable simplicity in construction, lower cost and greater maneuverability of the lift truck.

While I have illustrated and described several specific embodiments of my invention it will be understood that these are by way of illustration only and that various changes and modifications are contemplated in my invention within the scope of the following claims.

I claim:

1. In combination with a crane hook, a table-like framework having a top portion suspended centrally by said crane hook and having integral vertical legs depending from the sides thereof, one of which is in the form of a channel, a chain guided in said channel, a motor driven means driving said chain selectively into or out of said channel and underneath the load to be lifted, and means mounted at the bottom of the other leg for automatically locking a free end of said chain thereto, each of the links of said chain having a stop element arranged to prevent the adjoining interconnected link from pivoting in a downward direction when moved horizontally but allowing it to be pivoted in an upward direction when retracted into said channel to maintain the unretracted portion of the chain stiff in a horizontal direction.

2. The combination recited in claim 1 together with a second chain of the construction recited, and driving means for selectively driving said second chain into or out of a second channeled leg of said table, and a second means for locking the free end of said chain to the bottom portion of one of said legs opposite said second channeled leg.

* * * * *